US005950533A

United States Patent [19]

Kildune et al.

[11] Patent Number: 5,950,533

[45] Date of Patent: Sep. 14, 1999

[54] METHOD AND APPARATUS FOR TREATING EMBOSSED WEBS TO PROVIDE A SHADOW EFFECT AND EMBOSSED WEB WITH A SHADOW EFFECT

[75] Inventors: Joseph S. Kildune, Salem, N.H.; Hubert Perkins, Columbus, Miss.

[73] Assignee: GenCorp Inc., Fairlawn, Ohio

[21] Appl. No.: 08/966,669

[22] Filed: Nov. 10, 1997

[51] Int. Cl.[6] ..... B31F 1/07

[52] U.S. Cl. ..... 101/23; 101/32

[58] Field of Search ..... 101/23, 32, 3.1, 101/12, 22, 33, 34, 36, 5, 6

[56] References Cited

U.S. PATENT DOCUMENTS

| | | | |
|---|---|---|---|
| 1,259,986 | 3/1918 | Hope | 216/10 |
| 2,317,551 | 4/1943 | Ormond | 216/10 |
| 2,346,231 | 4/1944 | Ormond | 216/10 |
| 2,741,215 | 4/1956 | Cady et al. | 118/33 |
| 2,753,591 | 7/1956 | Stevens et al. | 26/97 |
| 2,858,232 | 10/1958 | Hushebeck et al. | 101/32 |
| 3,384,924 | 5/1968 | Schuetz et al. | 101/23 |
| 4,063,324 | 12/1977 | Junge | 15/100 |
| 4,110,152 | 8/1978 | Dunning et al. | 156/553 |
| 4,303,695 | 12/1981 | McCann et al. | 428/908.8 |
| 4,884,505 | 12/1989 | Piepmeier | 101/492 |
| 5,047,116 | 9/1991 | Luthi et al. | 156/643 |
| 5,292,565 | 3/1994 | Napier et al. | 101/333 |
| 5,555,801 | 9/1996 | Kroyer | 101/32 |

FOREIGN PATENT DOCUMENTS

| | | | |
|---|---|---|---|
| 0018554 | 5/1985 | Japan | 101/32 |

*Primary Examiner*—Edgar Burr
*Assistant Examiner*—Anthony H. Nguyen
*Attorney, Agent, or Firm*—Robert F. Rywalski; Thomas A. Meehan

[57] ABSTRACT

A web with an embossed surface with a plurality of lows separated by a plurality of highs is provided with a shadow effect by passing the web between a pair of counterrotating rollers, a backup roller for supporting the web on its reverse surface and an ink application roller for applying ink to selected portions of the embossed surface of the web. The ink application roller is formed of a hard elastomeric material and its outer surface is engraved to have a plurality of highs corresponding to and engaging the lows of the embossed surface of the web and a plurality of lows corresponding to and overlying the highs on the embossed surface of the web.

8 Claims, 2 Drawing Sheets

METHOD AND APPARATUS FOR TREATING EMBOSSED WEBS TO PROVIDE A SHADOW EFFECT AND EMBOSSED WEB WITH A SHADOW EFFECT

FIELD OF THE INVENTION

This invention relates to the treatment of embossed webs, such as vinyl-coated wall coverings, to provide a shadow effect by selectively applying a darkened ink formulation to lows of the vinyl surface of the web, that is, to portions of the web whose thickness is less than the thickness of other portions of the web.

BACKGROUND OF THE INVENTION

Vinyl-coated fabrics are widely used for many decorative applications, including wallcoverings, and many of such fabrics are embossed on the exterior, vinyl surfaces thereof to provide aesthetically pleasing visible surfaces, each with a series of highs and lows occurring in a regular pattern. Heretofore, it has been known to apply a darkening ink to the highs of the embossed surfaces of such webs to provide contrast between the highs and the lows, and this is usually done by passing the web between opposed rollers, a backup roller and an embossed surface contacting roller in the form of a smooth cylindrical roller to which a thin film of ink is continuously applied. U.S. Pat. No. 2,741,215 (Cady et al.) describes apparatus that can be used to apply a colorant to the highs of an embossed surface of web.

More interesting decorative patterns can be applied to an embossed surface of a web, however, by applying a darkening ink to the lows of the embossed surface and/or to the transitional regions between the highs and the lows, to provide the web with a shadow effect. Arrangements such as that of the aforesaid '215 patent are incapable of being used to impart such a shadow effect, however, because they utilize smooth, cylindrical ink-applicating rollers to apply the ink to the web.

SUMMARY OF THE INVENTION

According to the present invention, there is a provided method of and apparatus for applying ink to an embossed surface of a web to provide a shadow effect to the web by applying the ink to portions of the embossed surface of the web other than the highs of such embossed surface. The invention is practiced by passing the web between an opposed pair of rollers, a backup roller that contacts the reverse side of the web and an ink application roller that contacts the embossed side of the web. The ink application roller is formed of a hard, elastomeric material, and its external surface is engraved, for example, by laser engraving, to provide it with a pattern corresponding to the pattern of the embossed web but being oppositely directed with respect thereto. Thus, highs on the ink application roller contact lows on the web and/or transitional areas between the lows and the highs, while lows on the roller overlie highs on the web to either apply no ink thereto or a reduced thickness of ink thereto, thus providing the web with a visually pleasing shadow effect. The ink application roller has ink applied to its external surface, for example, by rotating it through an ink-containing tray immediately before the ink application roller contacts the embossed surface of the web.

Accordingly, it is an object of the present invention to provide a method and apparatus for providing a shadow effect to the embossed surface of an embossed web.

It is also an object of the present invention to provide an embossed web whose embossed surface is provided with a shadow effect.

For a further understanding of the present invention and the objects thereof attention is directed to the drawing and the following brief description thereof, to the detailed description of the preferred embodiment and to the appended claims.

DETAILED DESCRIPTION OF THE PREFERRED EMBODIMENT

Figure 1:
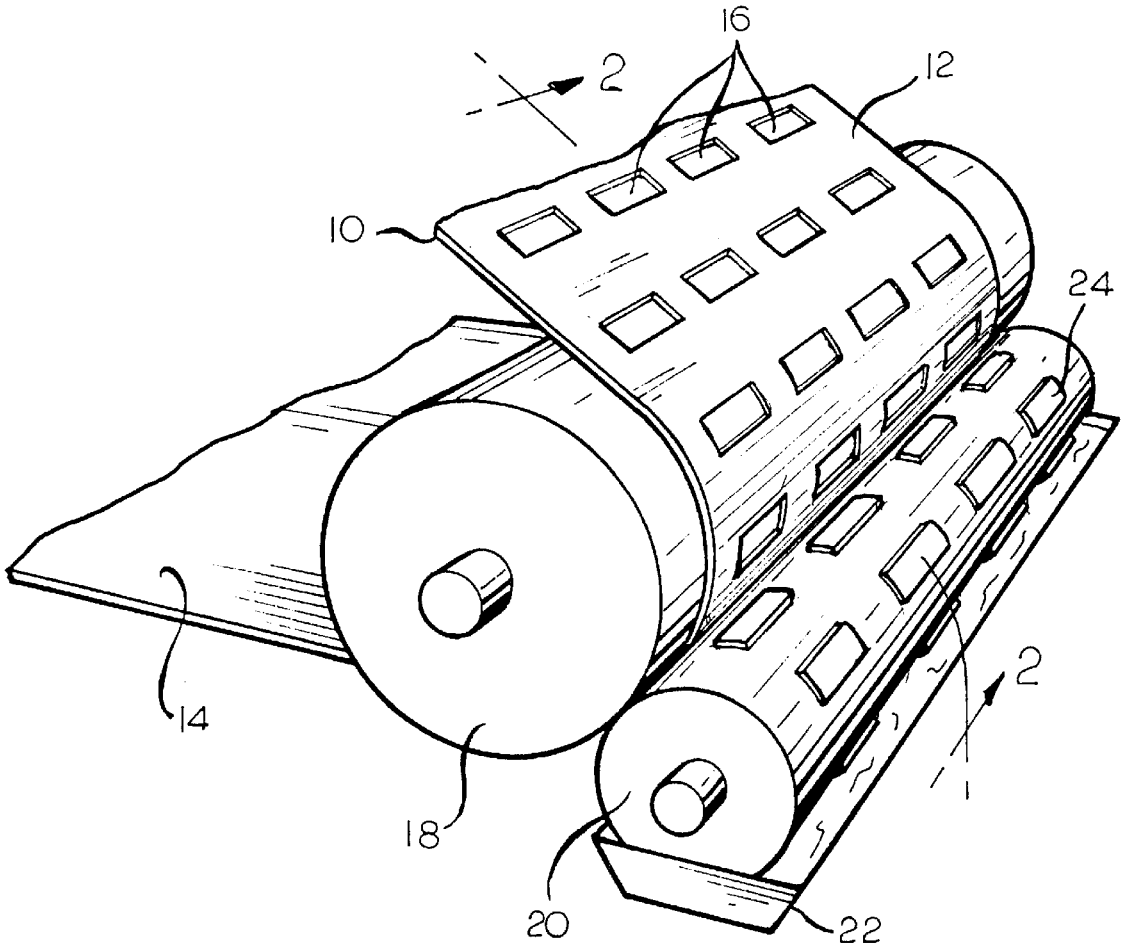
FIG. 1 is a fragmentary perspective view of apparatus for practicing the method of the present invention.
Figure 2:
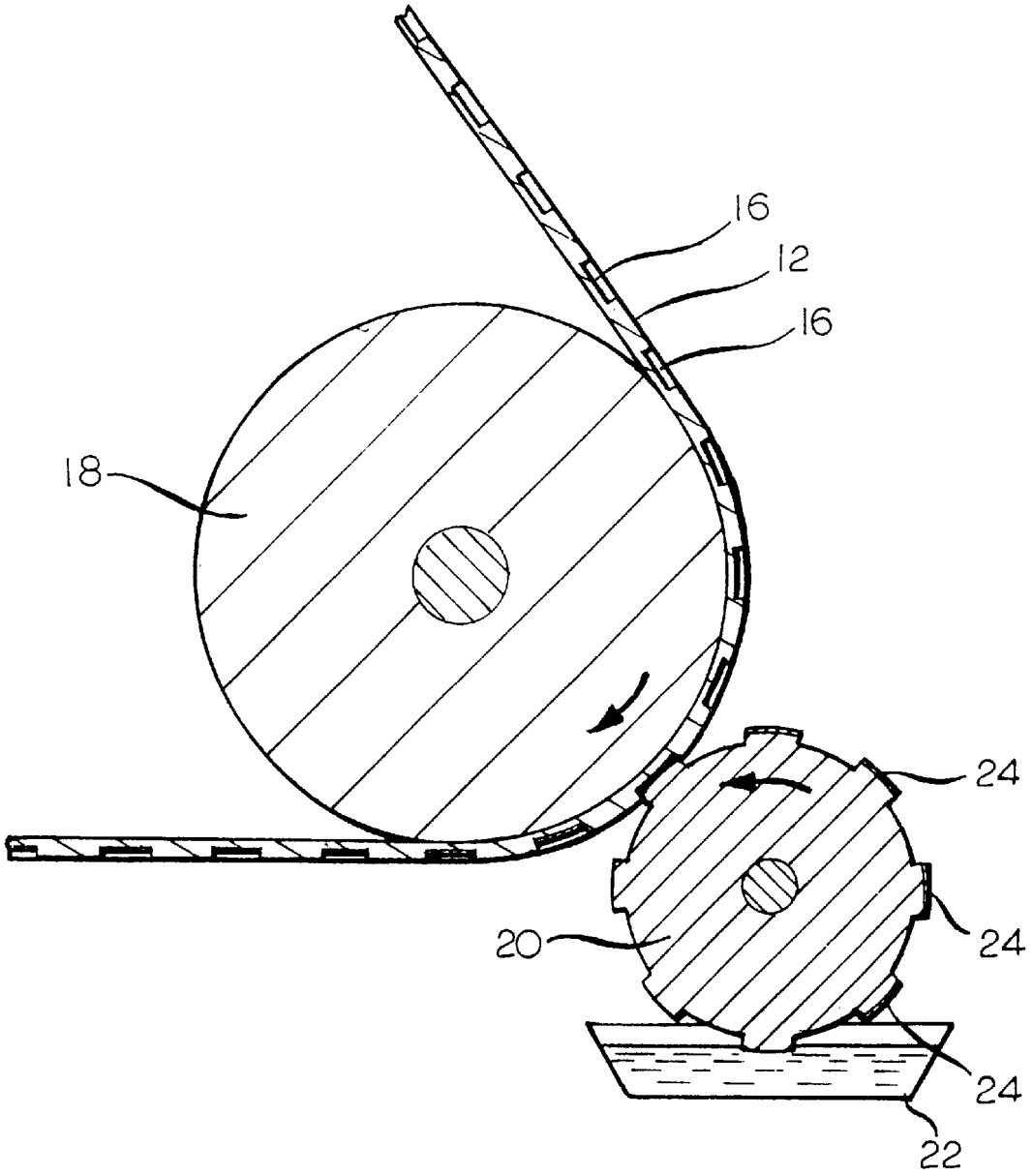
FIG. 2 is a sectional view taken on line 2—2 of FIG. 1.

FIG. 1 illustrates a web 10 having an embossed outer vinyl surface 12 applied over a woven fabric surface 14, of a type that is widely used as a wallcovering with the vinyl surface 12 facing away from the wall to which the web 10 is applied. For purposes of illustration, the embossing of the vinyl surface 12 is in the pattern of a multitude of spaced apart rectangular indentions 16, which form the lows of the vinyl surface 12, the portions of the vinyl surface 12 between the indentions 16, thus, being the highs of the vinyl surface 12. Of course, it is contemplated that the embossing of the vinyl surface 12 of the web may impart a much more complex and aesthetically pleasing configuration thereto, the use of rectangular indentions 16 being intended only to illustrate that a regularly occurring pattern may be imparted to the vinyl surface 12 of the web 10 by embossing.

To further accentuate the visual characteristics of the vinyl surface 12 of the web 10, a shadow effect is applied to the lows of the vinyl surface 12 and/or to the transitional regions between the lows and the highs by selectively applying a darkening ink to the regions to be shadowed. To this end, the web 10 is caused to pass between opposed, counterrotating rollers, a backup roller 18 that supports the woven fabric surface 14 of the web 10 and an ink application roller 20 that selectively applies ink to selected portions of the vinyl surface 12 of the web 10. In that regard, the ink application roller 20 rotates through an ink-containing tray 22 on each of its rotations, immediately before the ink-bearing surface of the ink application roller 20 engages the vinyl surface 12 of the web 10. The roller 20 is preferably formed of a hard, elastomeric material, such as an EPDM material for good solvent resistance, and is caused to apply ink to the vinyl surface 12 of the web 10 by engraving it, for example, by laser engraving, to provide it with a series of highs 24 that engage the indentations 16 of the vinyl surface 12 of the web 10 when the motion on the web 10 is properly registered and synchronized with the rotation of the roller 20. Thus, the highs 24 of the roller 20 are separated by lows that overlie the highs on the vinyl surface 12 of the web 10 as the web 10 is passing between the rollers 18 and 20, either not to apply any ink thereto or to apply a reduced amount thereto with respect to the amount being applied to the lows and/or the transitional regions of the vinyl surface 12 of the web 10. In any case, the use of an EPDM material in the manufacture of the roller 20, even a hard EPDM material, will result in the application of ink to the vinyl surface 12 of the web 10 in a more controlled manner than could be obtained with a roller 20 manufactured from a metal, because an EPDM roller 20 will impart the ink to the vinyl surface 12 with a squeegee effect.

Although the best mode contemplated by the inventors for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

We claim:

1. A method of providing a shadow effect to an embossed surface of a web having raised surface portions and recessed surface portions, the method comprising:

providing an ink application roller having an engraved outer surface with recessed surface portions corresponding to the raised surface portions of the web and raised surface portions corresponding to the recessed surface portions of the web;

applying an ink to the outer surface of the roller; and passing the web between the ink application roller and a smooth cylindrical backup roller so that the raised surface portions of the ink application roller engage the recessed portions of the web and the recessed surface portions of the ink application roller overlie the raised surface portions of the web.

2. A method according to claim 1 wherein the web comprises a woven fabric web with a vinyl surface applied thereto, the embossed surface being the vinyl surface of the web.

3. A method according to claim 2 wherein at least an outer ink application surface of the ink application roller is formed of a hard, elastomeric material.

4. A method according to claim 3 wherein the engraved outer surface of the ink application roller is engraved by laser engraving.

5. Apparatus for providing a shadow effect in combination with a web having raised surface portions and recessed surface portions on a first surface of said web, said web further having an opposed, second surface, said apparatus comprising:

an ink application roller having an engraved outer surface with recessed surface portions corresponding to the raised surface portions of the first surface of the web and raised surface portions corresponding to the recessed surface portions of the first surface of the web;

means for applying an ink to an outer surface of the ink application roller; and a smooth cylindrical backup roller for contacting the second surface of the web, said backup roller being positioned with respect to said ink application roller to form a nip therebetween, to thereby position the web with respect to the ink application roller when the ink application roller contacts the surface of the web.

6. Apparatus according to claim 5 wherein at least an outer, surface portion of the ink application roller is formed of a hard, elastomeric material.

7. Apparatus according to claim 5, wherein the engraved outer surface of said ink application roller is engraved by laser engraving.

8. Apparatus according to claim 5 wherein said ink application roller is rotatable, and wherein said means for applying an ink comprises an ink-containing tray through which at least an outer, ink-bearing surface of said ink application roller passes on each rotation of said ink application roller.

* * * * *